US008136250B2

(12) United States Patent
Floessholzer

(10) Patent No.: US 8,136,250 B2
(45) Date of Patent: Mar. 20, 2012

(54) CUTTING UNIT WITH GUARD TEETH AND HAIR-CUTTING DEVICE

(75) Inventor: Hannes Floessholzer, St. Paul (AT)

(73) Assignee: Koninklijke Philips Electronics N.V., Eindhoven (NL)

( * ) Notice: Subject to any disclaimer, the term of this patent is extended or adjusted under 35 U.S.C. 154(b) by 898 days.

(21) Appl. No.: 12/097,259

(22) PCT Filed: Dec. 11, 2006

(86) PCT No.: PCT/IB2006/054731

§ 371 (c)(1), (2), (4) Date: Jun. 12, 2008

(87) PCT Pub. No.: WO2007/069177

PCT Pub. Date: Jun. 21, 2007

(65) Prior Publication Data

US 2008/0263869 A1 Oct. 30, 2008

(30) Foreign Application Priority Data

Dec. 12, 2005 (EP) ..... 05111948

(51) Int. Cl.
*B26B 19/38* (2006.01)
*B26B 19/06* (2006.01)

(52) U.S. Cl. ..... 30/43.92; 30/346.51

(58) Field of Classification Search ..... 30/34.2, 30/43, 43.9, 43.92, 223, 224, 346.51, 225
See application file for complete search history.

(56) References Cited

U.S. PATENT DOCUMENTS

| | | | | |
|---|---|---|---|---|
| 1,596,241 | A * | 8/1926 | Donnellon | 30/223 |
| 2,004,087 | A * | 6/1935 | Testi | 30/34.2 |
| 2,152,815 | A * | 4/1939 | Muros | 30/43.92 |
| 2,370,544 | A * | 2/1945 | Jepson et al. | 30/34.1 |
| 4,512,077 | A * | 4/1985 | Tanabe et al. | 30/43 |
| 6,405,439 | B1 | 6/2002 | Malobabic | |
| 6,418,622 | B2 * | 7/2002 | Garenfeld et al. | 30/43 |
| 2011/0016727 | A1 * | 1/2011 | Fuerst et al. | 30/208 |

FOREIGN PATENT DOCUMENTS

| | | |
|---|---|---|
| DE | 102005002895 | 7/2006 |
| FR | 1069422 | 7/1954 |
| FR | 2003053063 | 2/2003 |
| GB | 453336 | 9/1936 |

* cited by examiner

*Primary Examiner* — Hwei C Payer
(74) *Attorney, Agent, or Firm* — Sherry Austin

(57) ABSTRACT

To minimize the risk for injuries due to hooked hair catching teeth, but still have a reasonable hair-cutting efficiency, a cutting unit (107) for a hair-cutting device (100) having two blades (202, 206) moving relatively to each other with at least one of the blades (202, 206) being toothed is proposed, wherein at least some teeth (208) have a larger cross-sectional area (CA) at their free end (210) than at their end (212) making the junction with the blade (206), wherein the larger cross-sectional area (CA) is 0.3 mm2 or more and wherein the shape of the larger cross-sectional area (CA) is such that the tooth (208) surface oriented to face the surface (305) with hair (301) to be cut when cutting has a larger distance to the middle axis (M) than the equivalent surface of the blade-side-end (212).

8 Claims, 9 Drawing Sheets

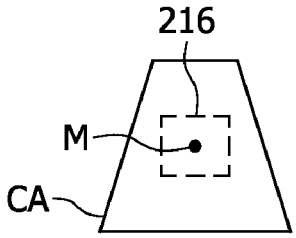
FIG. 6f
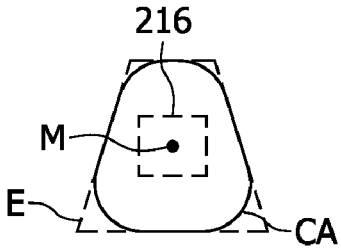
FIG. 6g
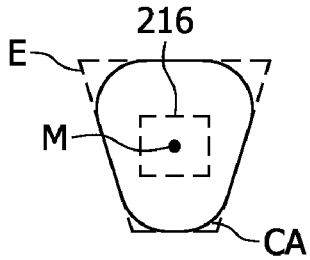
FIG. 6h
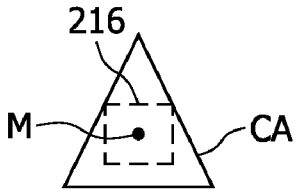
FIG. 6i
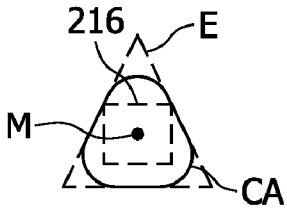
FIG. 6j
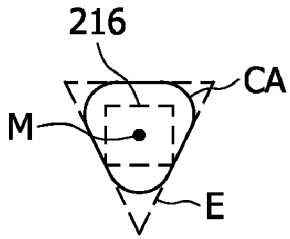
FIG. 6k
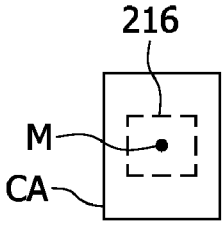
FIG. 6l
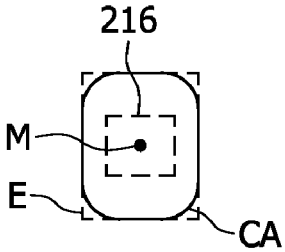
FIG. 6m
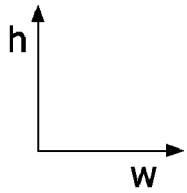

A - A

CUTTING UNIT WITH GUARD TEETH AND HAIR-CUTTING DEVICE

The present invention relates to a cutting unit for a hair-cutting device having two blades moving relatively to each other with at least one of the blades being toothed.

The present invention further relates to a hair-cutting device with a cutting unit according to the present invention.

In particular for cutting hair very short, i.e. for shaving hair for aesthetic or medical purpose, hair-cutting devices have mostly cutting units with two blades that are moving with respect to each other. In most cases one blade is stationary and the other one is reciprocating. The blades usually have teeth for cutting hair more efficiently. Hair-cutting devices that are used to actually shave body portions often have a cutting unit to precut long hairs and have shaving unit, e.g. a foil shaver or a rotor-shaver to cut the hairs close to the skin.

For safety reasons, the stationary blade is normally chosen to be next to the skin with hair to be cut, thus shielding the skin from the reciprocating blade to avoid injuries. It then works like a guard against cutting the skin. Nonetheless, in areas where the skin is very sensitive, e.g. in the armpit and the pubic area, injuries still happen.

One common cause for injuries is a too large distance between the teeth of the stationary blade. When cutting or shaving, the skin is pressed between the teeth of the guard, leading to a "skin-doming" effect. If the skin reaches the reciprocating blade, it will be cut.

Another, more complex, common cause for injuries is that the guard teeth of existing hair cutting devices happen to hook into a skin pore or a hair channel. The skin is then stretched on both sides of the hooked tooth and can be reached by the reciprocating blade cutting the skin.

U.S. Pat. No. 6,405,439 B1 addressed this problem by providing a toothed cutting device for a hair-cutting device consisting of a first toothed cutter having at least one row of cutter teeth and of a second toothed cutter having at least one row of hair catching teeth having each a non-bent first portion, which extends from a respective tooth base and a bent second portion which adjoins the first portion and which extends up to a free end of the respective hair tooth, a distance L existing between bounding faces of the non-bent first portions and the free ends, L being between 0.7 mm and 1.3 mm. Bending the free end of a hair catching tooth indeed efficiently prevents injuries due to hooking, but tests have shown that the hair-cutting itself becomes very inefficient. The hair catching function is substantially reduced, making the actual cutting time 40% longer compared to conventional devices.

It is therefore an object of the present invention to provide a hair cutting unit, respectively a hair-cutting device minimizing the risk for injuries due to hooked hair catching teeth, but still having a reasonable hair-cutting efficiency.

This object is achieved by a cutting unit for a hair-cutting device having two blades moving relatively to each other with at least one of the blades being toothed, wherein at least some teeth have a larger cross-sectional area at their free end than at their end making the junction with the blade, wherein the larger cross-sectional area is 0.32 $mm^2$ or more and wherein the shape of the larger cross-sectional area is such that the tooth surface oriented to face the surface with hair to be cut when cutting has a larger distance to the middle axis than the equivalent surface of the blade-side-end of the tooth.

Test with different sizes of cross-sectional areas at the free tooth end have shown that with cross-sectional areas at the free ends of 0.32 $mm^2$ or more the risk for hooking injuries is so significantly reduced that no injuries have happened yet.

By combining the thicker free end with the specific feature of having the free end bulge to the side oriented to the skin during hair cutting, the cutting efficiency is preserved while avoiding hooking injuries. The cutting unit according to the present invention with the specially shaped teeth allows a maximum of hair to be efficiently caught by the teeth, because only the hairs directly under the bulging free end are temporarily bent down. As soon as the hair-cutting device is moved on, these hairs stand upright, too, and can be reached and cut by the reciprocating blade.

In preferred embodiments, the shape of the larger cross-sectional area is such that the tooth surface opposite to the surface oriented to face the surface with hair to be cut when cutting has a larger distance to the middle axis than the equivalent surface of the blade-side-end of the tooth. This particularly enhances the effect of minimizing the risk of injuries due to hooking of the teeth in skin pores or hair channels.

Advantageously, all teeth have a larger cross-sectional area at their free end than at their end making the junction with the blade, wherein the larger cross-sectional area is 0.32 $mm^2$ or more and wherein the shape of the larger cross-sectional area is such that the tooth surface oriented to face the surface with hair to be cut when cutting has a larger distance to the middle axis than the equivalent surface of the blade-side-end, thus enhancing the positive effect of significantly reducing the risk of hooking a teeth into a skin pore or a hair channel, while still providing an efficient hair-cut.

In preferred embodiments, the shape of the larger cross-sectional area is such that at least one side surface of the free end has a larger distance from the middle axis than the equivalent side surface of the blade-side-end of the tooth. Using wider free tooth ends allows optimizing the distance between the teeth. At the free end, the distance can be chosen small enough to avoid skin-doming, at the other end, the distance can be chosen large enough to catch as many hairs as possible.

Preferably, the cross-sectional area of the free end is smaller than the cross-sectional area of the middle part. This makes sure that only the absolutely necessary part of the teeth is thicker than the teeth ends on the blade side. A maximum of the teeth is thin and provides efficient hair catching and thus effective hair cutting, while still being highly secure.

Advantageously, the shape of the larger cross-sectional area has a height being equal or greater than the width. This more efficiently prevents hooking into a skin pore or a hair channel while still bending down a minimum of hairs.

Preferably, the shape of the larger cross-sectional area is such that its enveloping curve has basically the shape of a circle, an ellipse, a triangle or a trapezoid. In simple cases the larger cross-sectional area itself can have the shape of basically a circle, an ellipse, a triangle, a trapezoid or a rectangle. These shapes have the advantage to be relatively easily produced and still show the features necessary to prevent hooking injuries. Embodiments with more elaborated teeth can have cross-sectional areas with more varied shapes, e.g. to utilizes less material. Due to the enveloping curve of these shapes having the shape of basically a circle, an ellipse, a triangle, a trapezoid or a rectangle, the risk for injuries due to hooking is still efficiently reduced.

It has shown to be advantageous, if the larger cross-sectional area is equal or more than 0.35 $mm^2$. On the other hand, the area should not be too large to not prevent an efficient hair catching effect.

In a further aspect of the present invention, this object is achieved by a haircutting device with a cutting unit as described above. In preferred embodiments, the hair-cutting device is implemented as shaving device with a shaving unit in addition.

A detailed description of the invention is provided below. Said description is provided by way of a non-limiting example to be read with reference to the attached drawings in which.

Figure 7:
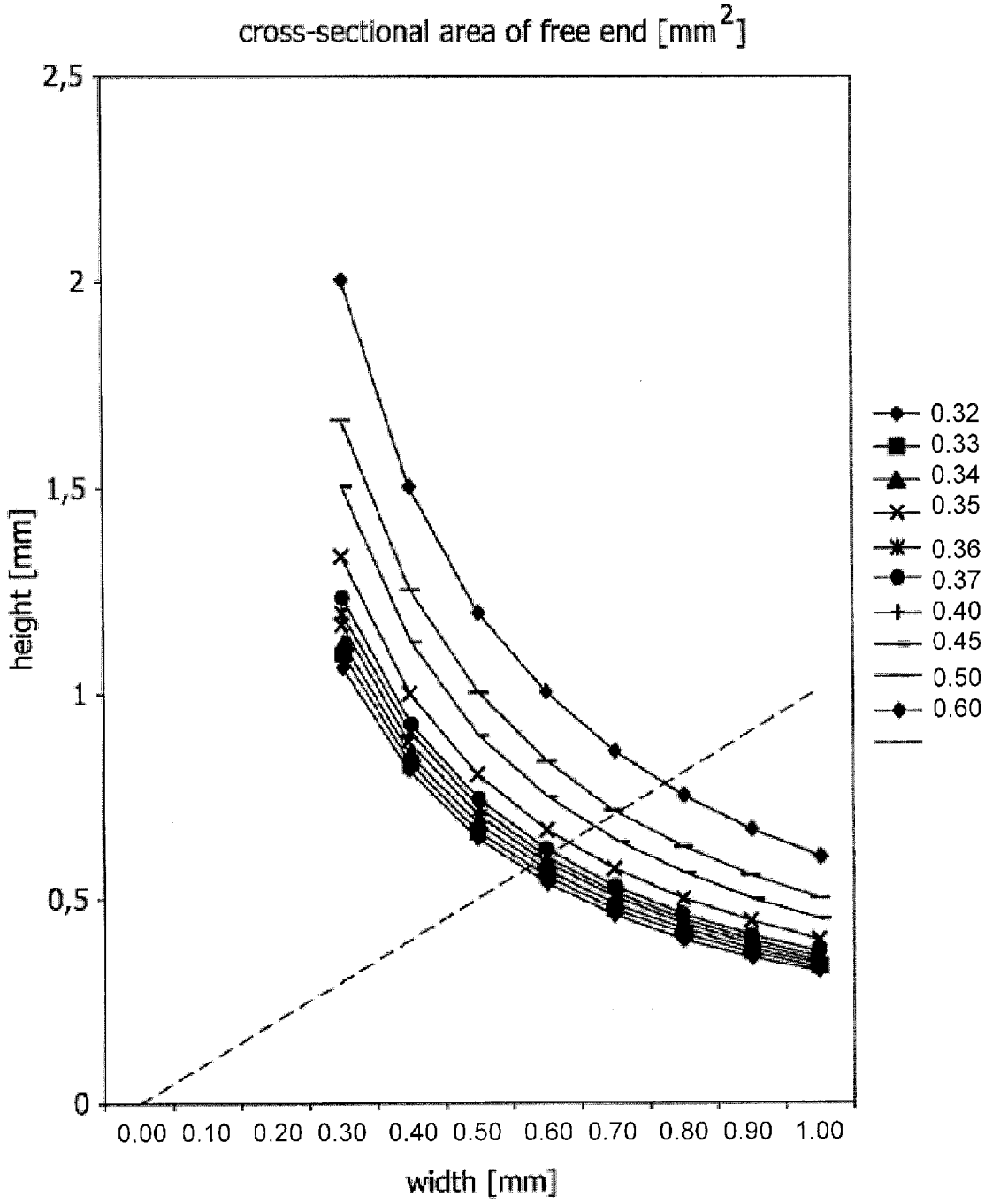

FIGS. 6*a-m* illustrate different geometries of guard teeth of a cutting unit according to the present invention;

FIG. 7 illustrates preferred dimensions of the free end of a guard tooth of a cutting unit according to the present invention; and FIGS. 8*a-f* illustrate an embodiment of a stationary blade of a cutting unit according to the present invention.

Figure 1:
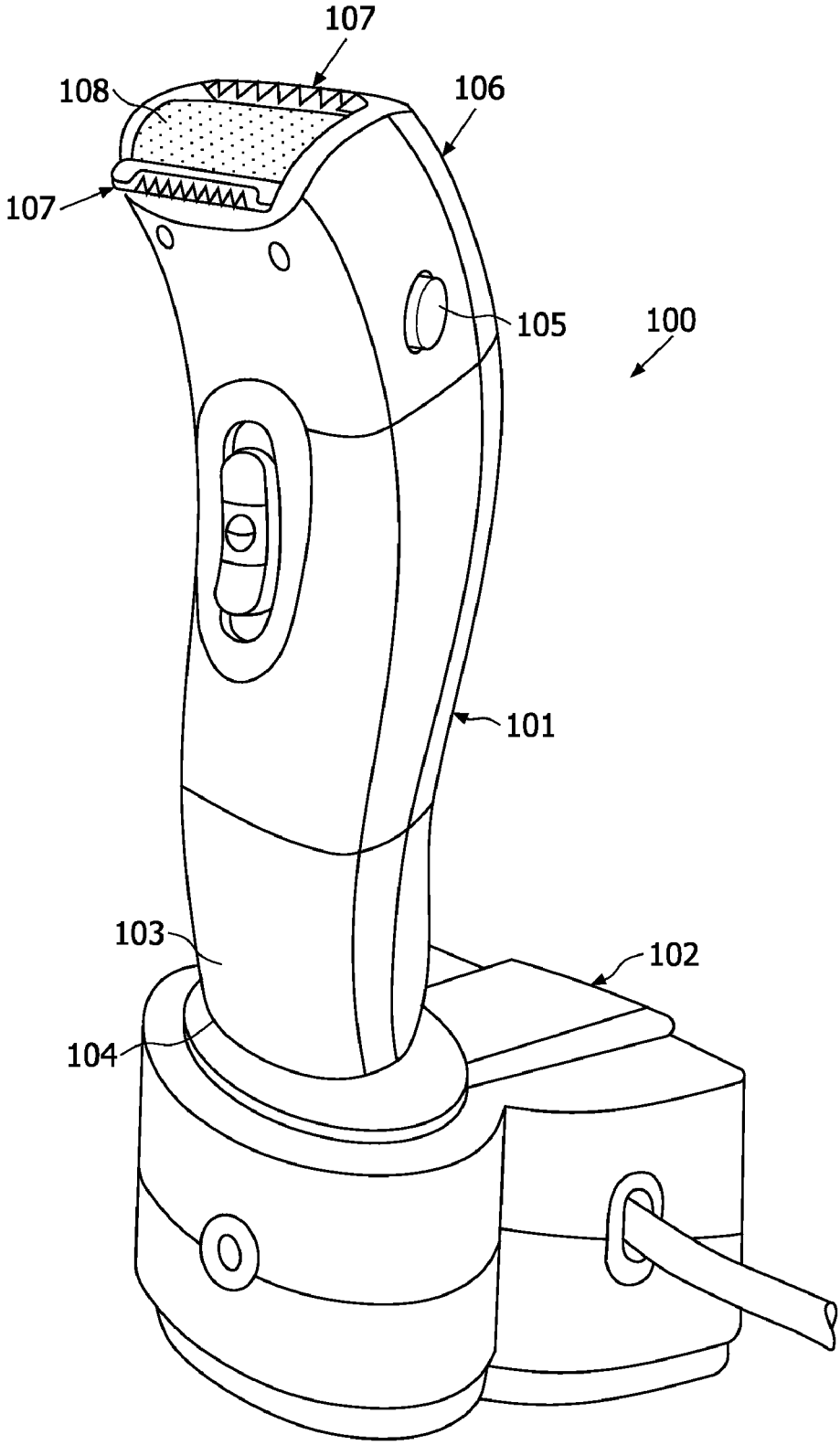
FIG. 1 shows a preferred embodiment of the hair-cutting device according to the present invention.

FIG. 1 shows a hair-cutting device 100 in the form of a shaving apparatus for women, a so-called lady shaver. With its lower end portion 103 the lady shaver 100 is plugged into a receptacle 104 of a charger 102 in order to charge rechargeable batteries accommodated in the lady shaver 100.

The lady shaver 100 has a housing 101 with an ergonomically curved shape. The housing 101 carries a cutting head 106 with cutting and shaving units 107, 108, which are detachably mounted in the housing 101 by latching devices, not shown. The latching devices can be released via two push buttons on opposite sides of the housing 101, one push-button 105 being visible in the perspective of FIG. 1.

The cutting head 106 comprises two cutting units 107 with toothed blades on either side of the shaving unit 108, which are shown only diagrammatically in FIG. 1. The cutting units 107 serve to pre-cut longer hair in opposite direction, depending on the body part to be shaved, before shaving it with the shaving unit 108, in the present case a shear foil cooperating with a drivable lower cutter not shown in FIG. 1. The design of the cutting units 107 according to the invention and their function will be explained more in detail below.

Figure 2:
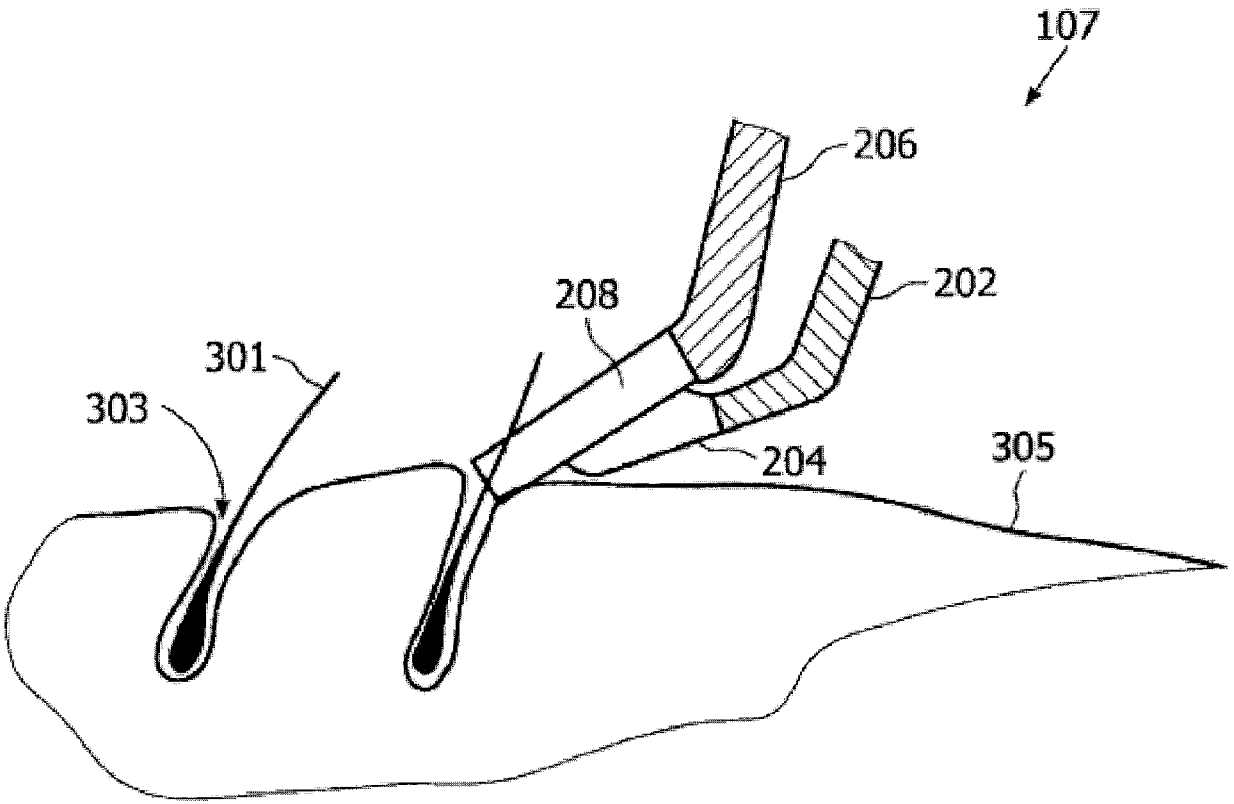
FIG. 2 PRIOR ART
FIG. 2 illustrates a guard tooth hooking into a hair channel.
Figure 3:
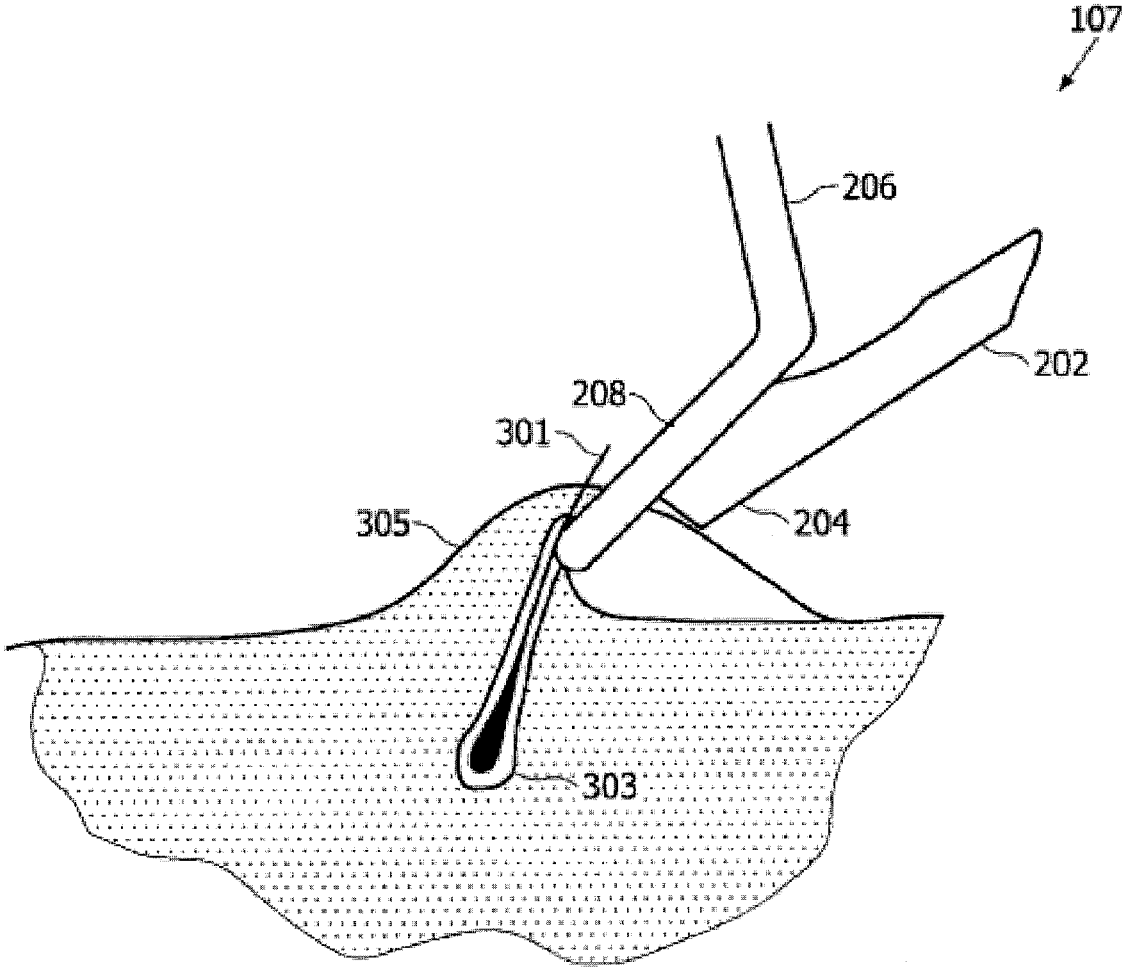
FIG. 3 PRIOR ART
FIG. 3 illustrates the effect of "skin-doming"
Figure 4:
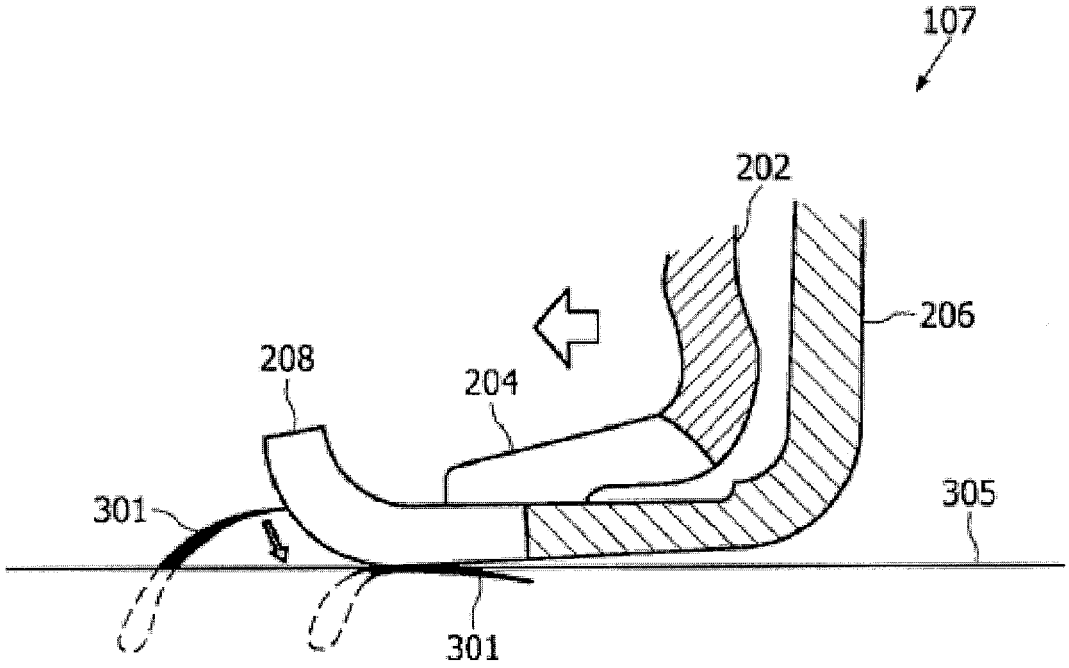
FIG. 4 PRIOR ART
FIG. 4 illustrates the effect of hair flattening.

FIGS. 2, 3 and 4 illustrate the problems encountered with conventional cutting units. The cutting unit 107 of FIG. 2 has a reciprocating blade 202 with cut teeth 204 for actually cutting hair 301, and a stationary blade 206, its guard teeth 208 intended to operate as guarding shield between the skin 305 and the cut teeth 204 of the reciprocating blade 202 and dimensioned to provide an optimal hair catching effect. When cutting hair on body regions with larger skin pores or hair channels 303, it unfortunately happens that a guard tooth 208 has approximately the size of or is even smaller than the orifice of e.g. a hair channel 303. The guard tooth 208 then penetrates the orifice and is stuck. This leads to a stretching and eventually a tearing of the skin 305 around the guard tooth 208 and furthermore, instead of hair 301 skin 305 is positioned between the guard tooth 208 and adjacent cut teeth 204 and is cut.

The effect of "skin doming" in addition to hooking in a hair channel 303 is illustrated in FIG. 3. The guard teeth 208 being widely apart to catch a maximum of hair, the skin 305 is pressed between the guard teeth 208, too, and thus can be reached by the cut teeth 204 and cut.

As mentioned before, to prevent hooking of the guard teeth 208 as explained with respect to FIG. 2, U.S. Pat. No. 6,405,439 B1 discloses bent guard teeth 208 that "glide" over the skin 305 without any possibility for hooking into skin pores or hair channels 303, as shown schematically in FIG. 4. But when the hair-cutting device is moved over the skin to proceed with cutting, this kind of guard teeth 208 bends down the hairs 301 to be cut and flattens them down onto the skin 305, where they cannot be reached and cut by the cut teeth 204.

Figure 5:
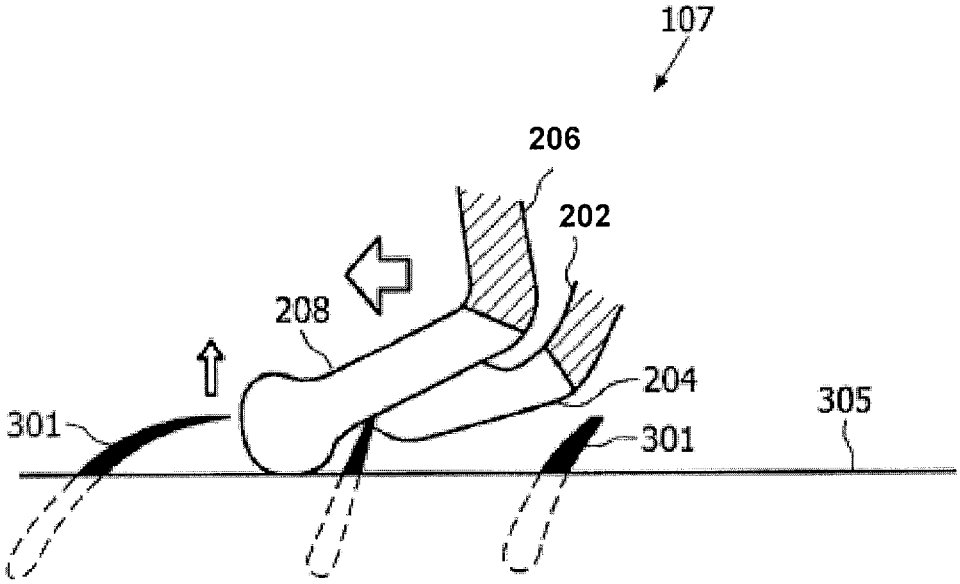
FIG. 5 illustrates the operation of a cutting unit according to the present invention.
Figure 6A:
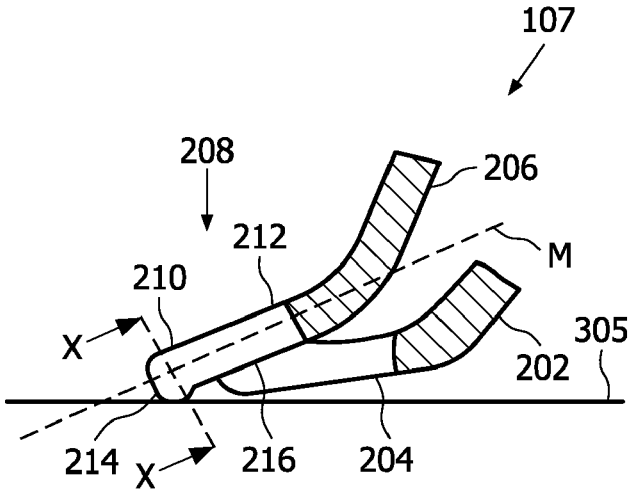
Figure 6B:
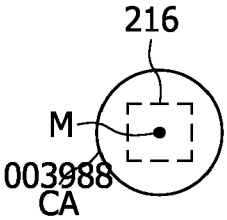
Figure 6C:
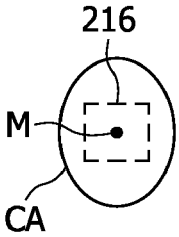
Figure 6D:
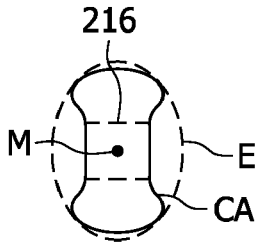
Figure 6E:
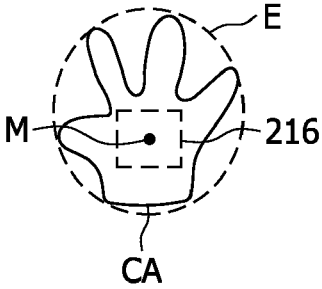
Figure 6E:
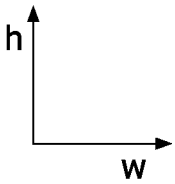

A cutting unit 107 according to the present invention and used in hair-cutting devices such as the lady shaver 100 of FIG. 1 is shown schematically in FIG. 5. The guard teeth 208 have a larger cross-sectional area at their free end 210 than in the middle part 216 and in particular the end 212 at the blade side. The cross-sectional area of the free end 210 is chosen to be 0.32 $mm^2$ or more to prevent hooking into skin pores or hair channels 303. The free end 210 has a bulge 214 on the downside facing the skin 305 not only to prevent hooking of the guard tooth 208, but also to ensure a good hair catching effect. Hair 301 under the respective guard tooth 208 is, if ever, only slightly bent and this only in the moment, when the bulge 214 is passing over it. It can still be reached by the cut teeth 204 and be cut. In most cases, the hair 301 is even pushed up by the bulge at the free end, as illustrated in FIG. 5, and passes along on the bulge's right or left side to be cut by the cut teeth 204. Thus, the hair catching effect and in consequence the hair cutting efficiency is approximately as good as with conventional cutting units.

By regulating the dimensions of the bulge 214 on the side surfaces, in particular with respect to the width of the blade-side-end 212 and eventually the width of the middle part 216, not only can the hair catching effect and the avoidance of hooking injuries be optimized, but also can the "skin-doming" effect be avoided by reducing the distance between adjacent free ends 210 of guard teeth 208.

FIG. 6*b-k* show schematically some possibilities of how to shape the cross-sectional area CA at the free end 210 of a guard tooth 208 of a cutting unit 107 according to the present invention. The cross-sectional areas CA are taken along the line X-X in FIG. 6*a* through the bulge 214 at the free end 210. Further is indicated the middle axis M of the guard tooth 208. All cross-sectional areas CA have a larger distance between the middle axis M and the lower surface facing the skin 305 while cutting than the blade-side-end 212 and the middle part 216 to ensure both a good hair catching effect and an avoidance of hooking injuries. All examples shown in FIG. 6 are also at least partially larger than the blade-side-end 212 and the middle part 216 to enhance both effects and also avoid injuries due to "skin-doming". Furthermore, all examples shown in FIG. 6 are higher than the blade-side-end 212 and the middle part 216 in particular to even more efficiently avoid hooking of the guard teeth 208.

The shapes can be chosen deliberately. Most preferred for efficiency and ease of production are cross-sectional areas CA with basically the shapes of circles (FIGS. 6*b,e*) or ellipses (FIGS. 6*c,d*) or triangles (FIGS. 6*i,j,k*) or trapezoids (Figures f,g,h) or rectangles (FIGS. 6*l,m*). It has been found that not only the "pure" shapes, but also shapes that can be circumscribed by an enveloping curve E having more or less these shapes are well-adapted for use in a cutting unit 107 according to the present invention. Their advantage is in most cases that they are easier to produce, need less material and thus are less expensive.

The preferred dimensions for the width w and the height h of the shape of the cross-sectional area CA at the free end 210 are illustrated in the graph of FIG. 7. Various heights and widths have been computed for several cross-sectional areas of the free end of a tooth according to the invention, i.e. 0.32 $mm^2$, 0.33 $mm^2$, 0.34 $mm^2$, 0.35 $mm^2$, 0.36 $mm^2$, 0.37 $mm^2$, 0.40 $mm^2$, 0.45 $mm^2$, 0.50 $mm^2$, and 0.60 $mm^2$. With these areas no hooking injuries have happened yet. Larger areas may have the drawback of impeding the hair catching effect and of necessitating larger blade-side-end and middle parts for stability. Widths below 0.3 mm have not been plotted, because for the time being it is difficult to produce such thin teeth having enough stability for repeated and intensive use.

In addition to the cross-sectional areas, a dotted line indicating width and height being equal has been plotted. For both particularly secure and efficient cutting units according to the present invention, it has shown to be advantageous to choose pairs of width and height on or above this dotted line.

Figure 8A:
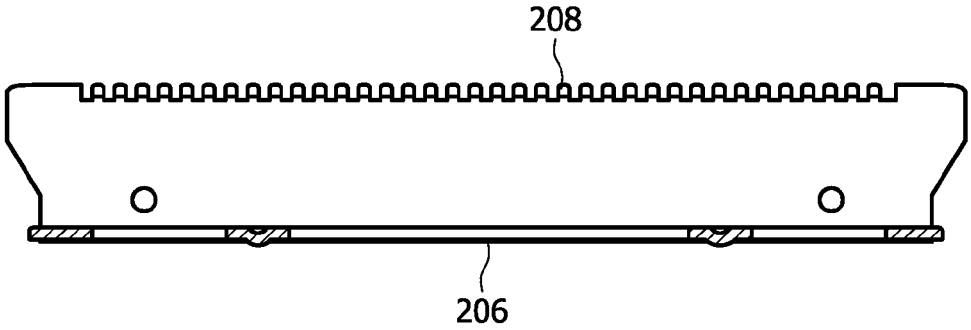
Figure 8B:
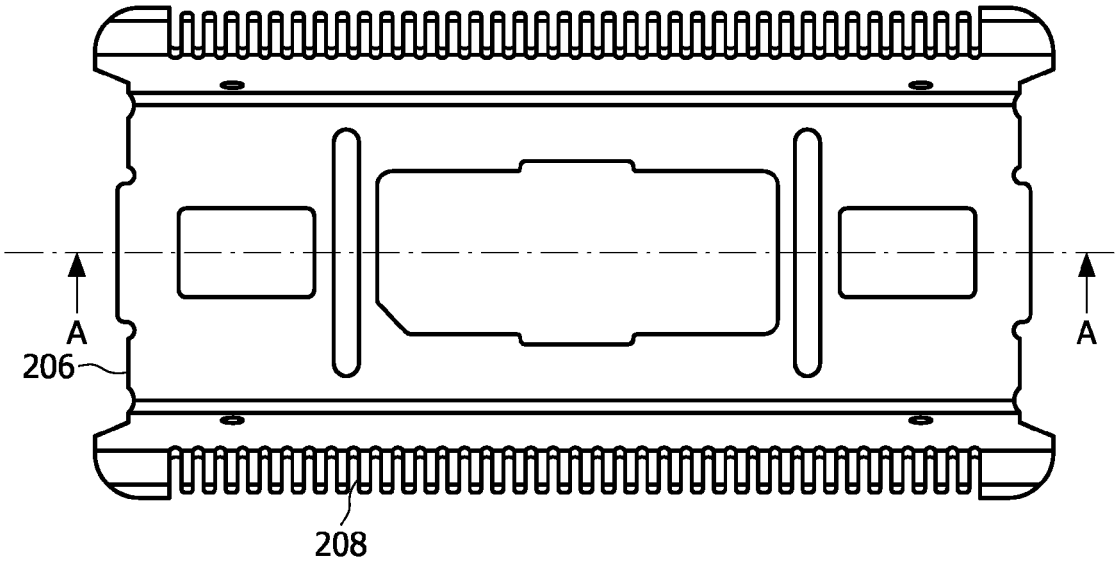
Figure 8C:
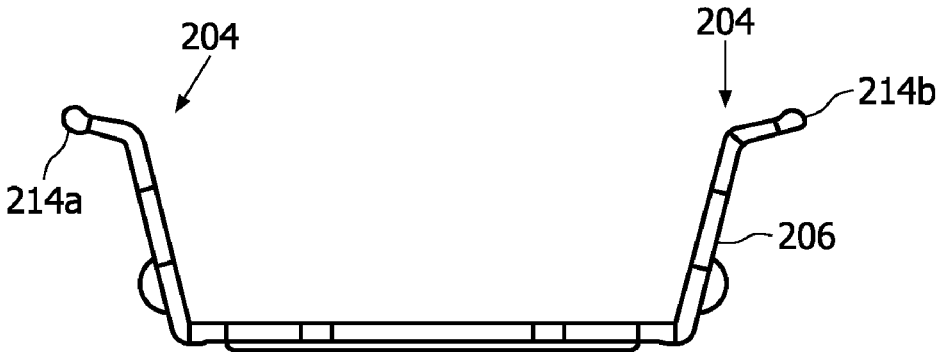
Figure 8D:
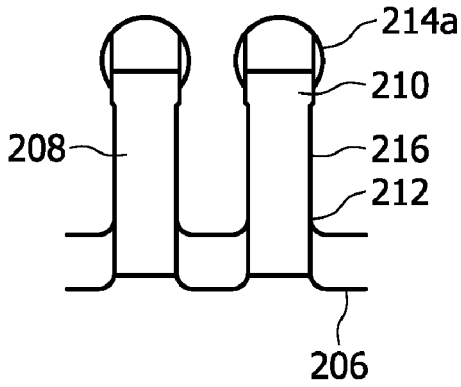
Figure 8E:
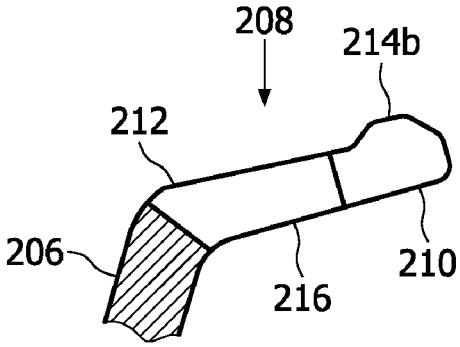

FIGS. 8*a-e* show an example of a two-sided stationary blade 206 as could be used in the cutting units 107 of the lady shaver 100 shown in FIG. 1. Each side of the two-sided stationary blade 206 can be positioned on either side of the shaving unit 108 to form a cutting unit 107 together with a respective reciprocating blade. Each side of the blade 206 has a multitude of guard teeth 208 as is illustrated in particular in FIGS. 8*a* and *b*, FIG. 8*a* being a cut along the line A-A in FIG. 8*b*. A cut perpendicular to the line A-A of FIG. 8*b* is shown in FIG. 8*c*.

It is possible to provide all or only some guard teeth 208 with a bulge. For example, guard teeth 208 with and without bulges can alternate to achieve a reduction of hooking injuries, or only areas of the stationary blade 206 with a high probability of hooking due to the particular shape of the body parts usually cut or shaved can be provided with bulges. But the most secure solution is to provide all guard teeth 208 with bulges at their free end.

Figure 8F:
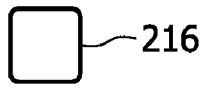

The guard teeth 204 shown in FIG. 8*c* have differently shaped bulges 214*a,b*. The left hand side bulge 214*a* has a spherical shape and the right hand side bulge 214*b* has an approximately semi-spherical shape bulging to the side facing the skin when cutting. The geometry of these kinds of guard teeth 208 is shown more in detail in FIG. 8*d* for the spherical bulge 214*a* and in FIG. 8*e* for the semi-spherical bulge 214*b*. The geometry of the remainder of the guard teeth is the same for both kinds of bulges 214*a,b*. FIG. 8*f* shows a cross-section of the blade-side-end 212 and the middle part 216, both being identical.

Although having described several preferred embodiments of the invention, those skilled in the art would appreciate that various changes, alterations, and substitutions can be made without departing from the spirit and concepts of the present invention. The invention is, therefore, claimed in any of its forms or modifications with the proper scope of the appended claims. For example various combinations of the features of the following dependent claims could be made with the features of the independent claim without departing from the scope of the present invention. Furthermore, any reference numerals in the claims shall not be construed as limiting scope.

LIST OF REFERENCE NUMERALS

100 lady shaver
101 housing
102 charger
103 lower end portion
104 receptacle
105 push button
106 cutting head
107 cutting unit
108 shaving unit
202 reciprocating blade
204 cut tooth
206 stationary blade
208 guard tooth
210 free end
212 blade-side-end
214(*a,b*) bulge
216 middle part
301 hair
303 hair channel
305 skin
M middle axis
CA cross-sectional area
E enveloping curve
h height
w width

The invention claimed is:

1. A haircutting device with a cutting unit, the cutting unit comprising:

a plurality of blades configured to be moved relative to each other; and a plurality of teeth, each of the plurality of teeth having a free end and a junction end joined to a corresponding end of one of the plurality of blades, wherein at least some teeth have a larger cross-sectional area at the free end than at the junction end joined to the corresponding end of one of the plurality of blades, wherein the larger cross-sectional area is at least 0.32 $mm^2$, wherein a distance from a surface of the free end facing a skin with hair to be cut to a middle axis of the tooth is greater than a distance from a surface of the blade facing the skin to the middle axis of the tooth, and wherein, for the teeth with the larger cross-sectional area, a distance from a surface of the free end opposite the surface facing the skin to the middle axis of the tooth is greater than a distance from a surface of the blade opposite the surface facing the skin to the middle axis of the tooth.

2. The haircutting device of claim 1, further comprising:

a shaving unit.

3. A cutting unit for a hair-cutting device, comprising:

two blades configured to be moved relative to each other; and a plurality of teeth joined to a portion of each blade, each tooth having a free end and an end joined to the blade, wherein at least some teeth have a larger cross-sectional area at the free end than at the end joined to the blade, wherein the larger cross-sectional area is at least 0.3 $mm^2$, wherein, for the teeth with the larger cross-sectional area, a distance from a surface of the free end facing a skin with hair to be cut to a middle axis of the tooth is greater than a distance from a surface of the blade facing the skin to the middle axis of the tooth, and wherein, for the teeth with the larger cross-sectional area, a distance from a surface of the free end opposite the surface facing the skin to the middle axis of the tooth is greater than a distance from a surface of the blade opposite the surface facing the skin to the middle axis of the tooth.

4. The cutting unit according to claim 1, wherein all teeth have the larger cross-sectional area at the free end, wherein the larger cross-sectional area is at least 0.32 $mm^2$.

5. The cutting unit according to claim 1, wherein at least one side surface of the free end has a greater distance to the middle axis than a side surface of the blade to the middle axis.

6. The cutting unit according to claim 1, wherein the shape of the cross-sectional area of the free end has a height equal to or greater than the width of the cross-sectional area.

7. The cutting unit according to claim 1, wherein the shape of the cross-sectional area of the free end is such that its enveloping curve has the shape of a circle, an ellipse, a triangle or a trapezoid.

8. The cutting unit according to claim 1, wherein the cross-sectional area of the free end is equal to or greater than 0.35 $mm^2$.

* * * * *